US008496346B2

(12) United States Patent
Zinox

(10) Patent No.: US 8,496,346 B2
(45) Date of Patent: Jul. 30, 2013

(54) ILLUMINATED NOVELTY TOPPER

(76) Inventor: Larry C. Zinox, Highland Park, IL (US)

( * ) Notice: Subject to any disclaimer, the term of this patent is extended or adjusted under 35 U.S.C. 154(b) by 197 days.

(21) Appl. No.: 13/179,998

(22) Filed: Jul. 11, 2011

(65) Prior Publication Data

US 2013/0016501 A1 Jan. 17, 2013

(51) Int. Cl.

| | |
|---|---|
| ***F21L 4/00*** | (2006.01) |
| ***F21L 13/00*** | (2006.01) |
| ***F21V 21/084*** | (2006.01) |
| ***F21S 6/00*** | (2006.01) |

(52) U.S. Cl.
USPC ..... 362/183; 362/106; 362/122

(58) Field of Classification Search
USPC ..... 362/183, 106, 122
See application file for complete search history.

(56) References Cited

U.S. PATENT DOCUMENTS

| | | | | |
|---|---|---|---|---|
| 2,685,022 | A | 7/1954 | Root et al. | |
| 4,296,659 | A | 10/1981 | Nauman | |
| 5,091,833 | A | 2/1992 | Paniaguas et al. | |
| 6,200,000 | B1 | 3/2001 | Burnidge | |
| 6,267,036 | B1 | 7/2001 | Lani | |
| 6,309,092 | B1 | 10/2001 | Bardeen et al. | |
| 6,513,945 | B1 | 2/2003 | Wyss et al. | |
| 6,540,371 | B2 | 4/2003 | Franks | |
| 6,705,741 | B2 | 3/2004 | Bonnema et al. | |
| 7,237,922 | B2 | 7/2007 | Cayton | |
| D623,555 | S * | 9/2010 | Reithlingshoefer et al. | D11/125 |
| 7,832,906 | B2 | 11/2010 | Damman | |
| 7,938,554 | B2 * | 5/2011 | Franks | 362/122 |
| 2003/0189825 | A1 | 10/2003 | Tauch et al. | |
| 2003/0210555 | A1 | 11/2003 | Cicero et al. | |
| 2005/0248952 | A1 | 11/2005 | Yao et al. | |
| 2005/0274242 | A1 | 12/2005 | McMahon et al. | |
| 2007/0114336 | A1 * | 5/2007 | Nottingham et al. | 248/27.8 |
| 2007/0190894 | A1 | 8/2007 | Grisoff | |
| 2008/0123326 | A1 | 5/2008 | Franks | |
| 2008/0130273 | A1 | 6/2008 | Norton et al. | |
| 2011/0261560 | A1 * | 10/2011 | Muccianti | 362/190 |

* cited by examiner

*Primary Examiner* — David J Makiya
(74) *Attorney, Agent, or Firm* — Levenfeld Pearlstein, LLC

(57) ABSTRACT

A device for illuminating the interior of a pumpkin, gourd or the like includes a housing having an interior region and a lighting assembly positioned at least in part within the interior region. The lighting assembly includes a rechargeable power source and a lighting element. The device includes a depending skirt extending from the housing and defining a recess. A photovoltaic collector is operably connected to the lighting assembly. The skirt is inserted into an opening in the pumpkin, gourd or the like, and the lighting element illuminates the interior of the pumpkin, gourd or the like. The photovoltaic collector recharges the rechargeable power source when exposed to ambient light.

12 Claims, 3 Drawing Sheets

ILLUMINATED NOVELTY TOPPER

BACKGROUND OF THE INVENTION

Illuminated commercial and novelty devices have become quite popular. Such devices include garden and pathway lighting, as well as pendants, pins and the like. Many such devices have increased in popularity as a result of the decrease in cost for solid-state illumination devices, such as LEDs. In that LEDs require much less power than conventional illumination devices such as incandescent lamps, portable power sources such as batteries (whether rechargeable or not) last much longer, also reducing the overall costs for novelty illumination.

Illumination devices are known for use with pumpkins, gourds and the like. For purposes of the present disclosure, such vegetables and others are collectively referred to as pumpkins. The pumpkin can be opened, as by a cut-out made on the top of the pumpkin, the internal flesh carved out, and cut-outs made though the skin. Cut-outs often take the form of eyes and a mouth forming a jack-o-lantern. In this manner a light placed in the pumpkin shines through the cut-out to provide a pleasing or scary aesthetic effect.

In known jack-o-lanterns, the top of the pumpkin that is cut out is removed and a light, such as an incandescent lamp or candle, is placed inside to provide illumination. LED modules are also known that can be placed inside of the jack-o-lantern. In such instances, the top potion of the pumpkin (that portion of the pumpkin surrounding the stem) is placed back onto the top of the pumpkin for aesthetics and to close the pumpkin. One drawback to using an incandescent lamp is that such lamps generate heat and can cause burns if touched. Another, is that the heat from the lamp can accelerate the degradation of the pumpkin. Likewise, candles can cause burns if touched, and can be blown out by wind.

Those familiar with pumpkin carving know that the top of the pumpkin is often the first part to degrade. Exposure of the top to air usually results in the top and the surrounding flesh/skin portion of the pumpkin to discolor, soften and perhaps attract insects. One solution is to coat the exposed pumpkin flesh with, for example, a clear coating such as varnish or the like. However, care must be taken to assure that the varnish is dry prior to use. Moreover, some of the coating that are used may be hazardous to one's health and/or the environment.

Accordingly, there is a need for a topper for a pumpkin, gourd or the like that provide illumination when the pumpkin or gourd is used as a jack-o-lantern. Desirably, such a topper uses low powered (low power requirement) illumination. More desirably still, such a topper serves as a partial seal for the pumpkin. Yet more desirably, such a topper can be used to mark the area on which the pumpkin, gourd or the like is cut.

SUMMARY

A device for illuminating the interior of a pumpkin, gourd or the like includes a housing having an interior region and a lighting assembly positioned at least in part within the interior region. The lighting assembly includes a rechargeable power source and a lighting element. A depending skirt extends from the housing and defines a recess in which the lighting element resides, at least in part. A photovoltaic collector is operably connected to the lighting assembly.

The skirt is inserted into an opening in the pumpkin, gourd or the like, and the lighting element illuminates the interior of the pumpkin, gourd or the like. The photovoltaic collector recharges the rechargeable power source when exposed to ambient light. In one illuminating device, the photovoltaic collector is mounted to the housing.

The illuminating device of claim 1 including a sensor operably connected to the lighting assembly, wherein the sensor detects the absence of ambient light to provide power to the lighting element.

In an embodiment, the skirt includes a free edge that is configured to mark the pumpkin, gourd or the like to form the opening therein. One free edge has an undulating or serrated profile.

The device can be formed as a hat, in which the housing is formed as a crown of the hat and a transition is formed as a brim of the hat. The skirt depends from the brim, opposite of the crown. The photovoltaic collector can be mounted to the crown of the hat. A cover can be disposed over the lighting element within the recess.

These and other features and advantages of the present invention will be apparent from the following detailed description, in conjunction with the appended claims.

BRIEF DESCRIPTION OF DRAWINGS

The benefits and advantages of the present invention will become more readily apparent to those of ordinary skill in the relevant art after reviewing the following detailed description and accompanying drawings, wherein.

DETAILED DESCRIPTION

Figure 1:
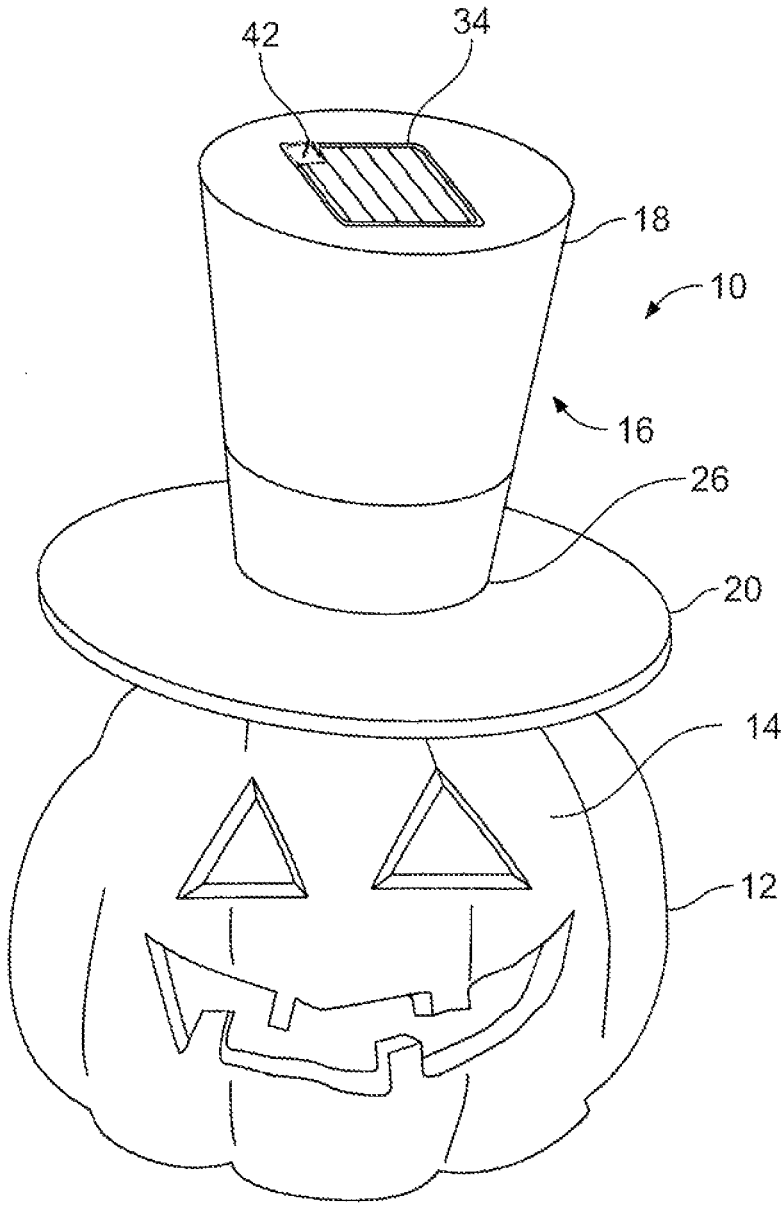
FIG. 1 is a perspective illustration of a pumpkin, carved as a jack-o-lantern, having a novelty illuminated topper positioned thereon.
Figure 2:
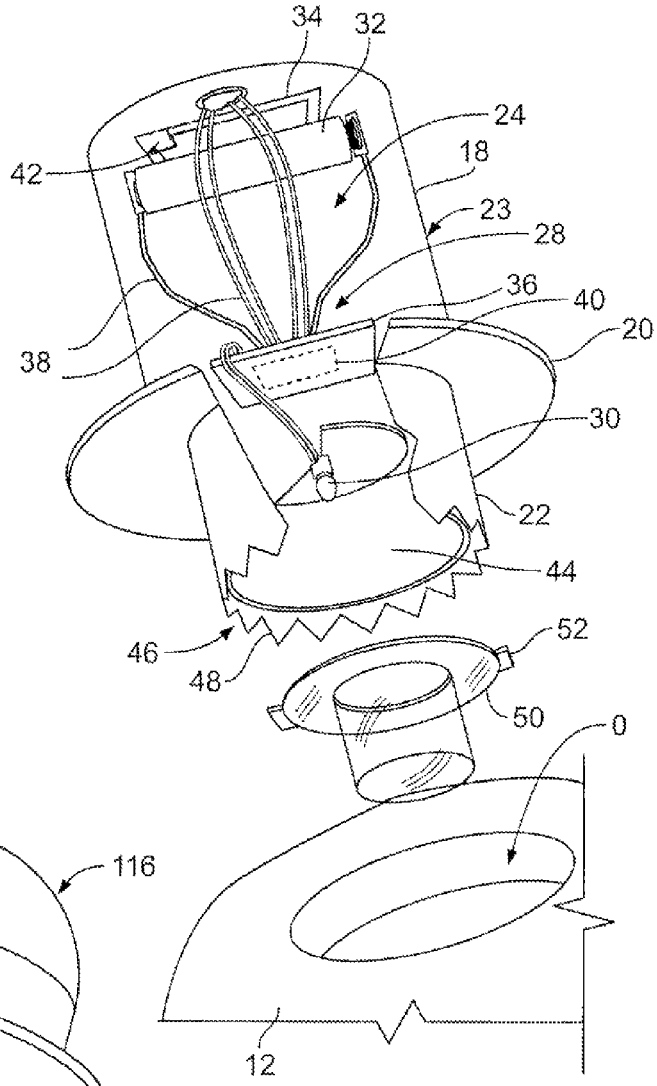
FIG. 2 is a partially cut-away view of the topper of FIG. 1.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to FIG. 1, an illuminated novelty topper 10 is shown positioned on a pumpkin 12 carved as a jack-o-lantern 14. It will be appreciated by those skilled in the art that while the topper 10 is shown positioned on a jack-o-lantern 14, the topper 10 can be used with a wide variety of other vegetables and other objects that are hollow or can be hollowed out and which have a sufficiently thick skin on which the topper 10 can be positioned.

In an embodiment, the topper 10 takes the form of a top hat 16 and includes a crown 18 and a brim 20, and includes a depending skirt 22. The crown 18 defines a housing 23 having an interior region 24, and the brim 20 is formed at a juncture 26 of the crown 18 and the skirt 22. The skirt 22 thus depends from the brim 20 opposite of the crown 18.

A lighting assembly or illumination module 28 is positioned in the hat interior region 24, preferably within the crown 18. In the illustrated embodiment, the lighting assembly 28 includes one or more lighting elements 30, such as LEDs and a power source 32. One such power source 32 is a battery. The illustrated topper 10 includes a photovoltaic cell 34 (e.g., a photocell or collector), circuitry that can be provided on, for example, a circuit board 36, and connectors 38 between the photocell 34, the circuit board 36, the battery 32 and the LED 30, as appropriate.

In one contemplated embodiment, the photocell 34 is used to provide power to and to recharge the battery 32, preferably .a rechargeable battery. Circuitry 40 can be configured to illuminate the LED 30 during the daytime, or it can be configured to recharge the battery 32 during the daytime and to illuminate the LED 30 during the evening hours. Those skilled in the art will recognize circuitry suitable to provide such nighttime illumination. A sensor 42, which can be formed as part of or separate from the photocell 34, can be used to sense the presence or absence of ambient light to illuminate the LED 30.

In a present embodiment, the LED 30 is mounted within the topper 10 at about the same height as the brim 20. The skirt 22, which depends from the brim 20, depends a distance greater than that of the LED 30—that is, the LED 30 is positioned within a recess 44 formed by the skirt 22. In this manner, the LED is protected from damage by the skirt.

The skirt 22 is formed with a free edge 46 opposite the juncture 26 with the brim 20. In a preferred embodiment, the free edge 46 has an undulating or serrated-like profile as indicated at 48. It is contemplated that the undulating edge 48 can be used as a template or marker, to mark the location (e.g., score the skin) on the pumpkin for cutting. It will be appreciated that using such a template or marker allows for making a cut in the pumpkin 12 such that the topper 10 has a close, snug fit in the pumpkin opening O, when placed on the jack-o-lantern 14. This can prevent or reduce degradation of the pumpkin 12 flesh after it is cut, and may allow the jack-o-lantern 14 to have a longer useful life than it might otherwise.

It is anticipated that the topper 10 will be manufactured from commonly available plastic or polymeric materials which can, if desired by colored or dyed, to provide a pleasing aesthetic effect.

Optionally, the topper 10 can include a protective cover 50 that is positioned over the LED 30 when, for example, the topper 10 is used to mark out the pumpkin 12. The cover 50 can be formed with any of a number of different mounting configurations, such as the illustrated bayonet mount 52. Alternately, the cover 50 can be formed from a material that is transparent or translucent (e.g., clear or light emitting) so that the cover 50 can be left in place when the topper 10 is used to illuminate the jack-o-lantern 14.

Figure 3:
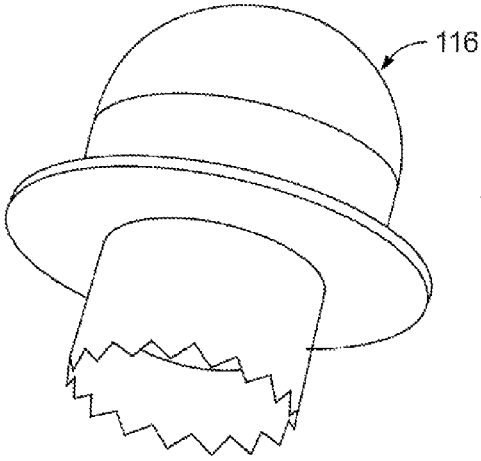
FIG. 3, 4A and 4B and 5-6 are perspective views of alternate embodiments of the topper.
Figure 4A:
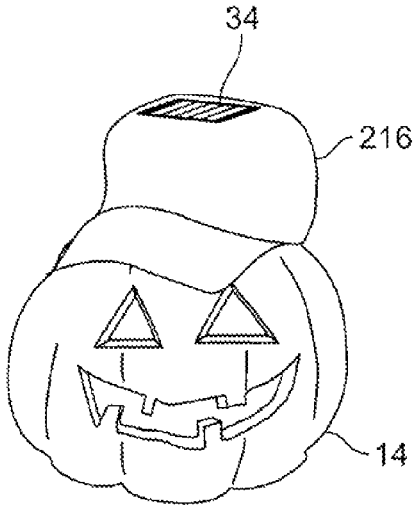
Figure 4B:
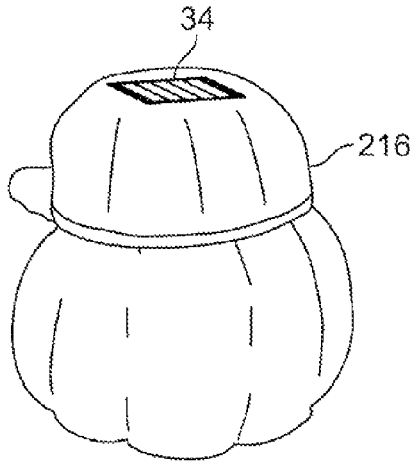
Figure 5:
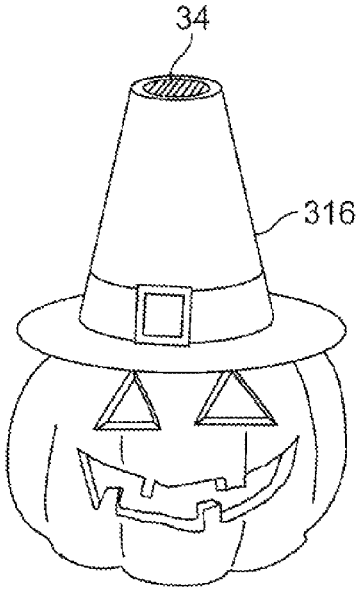
Figure 6:
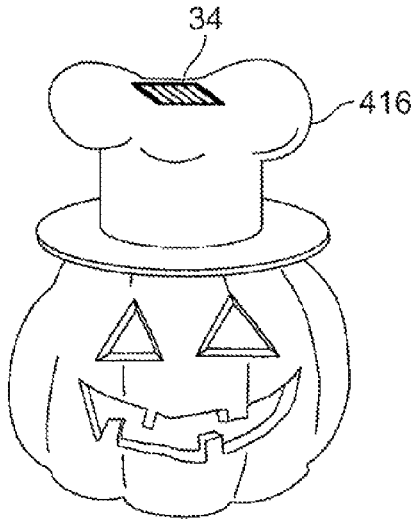

Alternate designs of hats 16 are shown in FIGS. 3-6. The hat can take the shape of a bowler 116 as shown in FIG. 3, a ball cap 216 as shown in FIGS. 4A and 4B, a conical pilgrim's hat 316 as shown in FIG. 5, and a chefs hat (or toque) 416 as shown in FIG. 6. The location of the photocell 34 in the bowler 116 of FIG. 3 can be similar to the photocell 34 location as illustrated in the ball cap 216 of FIGS. 4A and 4B.

It will also be appreciated that while the present topper 10 is shown and described as a hat 16-416, other configurations, shapes or designs can be used that incorporate the novel feature of the present topper 10. It will also be appreciated that although the topper is shown and described as used with a pumpkin, gourd or other like object, it can also be used with a wide variety of other objects, such as a snowman and the like, which other configurations, shapes or designs and uses are within the scope and spirit of the present disclosure.

The present topper 10 provides a number of advantages over other, known ways in which a jack-o-lantern is made and illuminated. First, the use of a low power LED greatly reduces any heat that an incandescent lamp or candle may subject the jack-o-lantern to. As such, there is little to no chance that a person can be burned. And there is considerably less heat to which the jack-o-lantern is subjected, thus less degradation. The present topper 10 can also light the jack-o-lantern automatically once dusk (or night-time) is sensed, thus precluding the need to remember to light a lamp or candle. The topper will remain illuminated even in winds that would otherwise blow out a candle.

In addition, the edge 48 allows for closely marking the pumpkin 12 to better or more closely cut the pumpkin to fit the topper 10. In that the skirt portion 22 depends from the brim 20 and is fitted into the pumpkin opening O, the topper will remain on the jack-o-lantern 14 once in position.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred.

What is claimed is:

1. A device for illuminating the interior of a pumpkin or gourd, comprising:

a housing having an interior region;

a lighting assembly positioned at least in part within the interior region, the lighting assembly including a rechargeable power source and a lighting element;

a depending skirt extending from the housing and defining a recess;

a photovoltaic collector operably connected to the lighting assembly, wherein the skirt is inserted into an opening in the pumpkin or gourd, and wherein the lighting element illuminates the interior of the pumpkin or gourd, and wherein the photovoltaic collector recharges the rechargeable power source when exposed to ambient light;

including a transition at the juncture of the housing and the skirt, wherein the device is formed as a hat, wherein the housing is formed as a crown of the hat and the transition is formed as a brim of the hat, and wherein the skirt depends from the brim, opposite of the crown.

2. The illuminating device of claim 1 wherein the skirt includes a free edge and wherein the free edge is configured to mark the pumpkin, gourd or the like to form the opening therein.

3. The illuminating device of claim 2 wherein the free edge is formed having an undulating edge.

4. The illuminating device of claim 1 wherein the photovoltaic collector is mounted to the housing.

5. The illuminating device of claim 1 including a sensor operably connected to the lighting assembly, wherein the sensor detects the absence of ambient light to provide power to the lighting element.

6. The illuminating device of claim 1 including a cover disposed over the lighting element within the recess.

7. A device for illuminating the interior of a pumpkin or gourd, comprising:

a housing having an interior region;

a lighting assembly positioned at least in part within the interior region, the lighting assembly including a power source and a lighting element;

a depending skirt extending from the housing and defining a recess, the skirt including an undulating free edge configured to mark the pumpkin or gourd to form the opening therein, wherein the skirt is inserted into an opening formed in the pumpkin or gourd, and wherein the lighting element illuminates the interior of the pumpkin or gourd;

including a transition at the juncture of the housing and the skirt, wherein the device is formed as a hat, wherein the housing is formed as a crown of the hat and the transition is formed as a brim of the hat, and wherein the skirt depends from the brim, opposite of the crown.

8. The illuminating device of claim 7 wherein the power source is a rechargeable power source and including a photovoltaic collector operably connected to the lighting assembly for recharging the rechargeable power source when exposed to ambient light.

9. The illuminating device of claim 8 including a sensor operably connected to the lighting assembly, wherein the sensor detects the absence of ambient light to provide power to the lighting element.

10. The illuminating device of claim 7 including a cover disposed over the lighting element within the recess.

11. The illuminating device of claim 8 wherein the photovoltaic collector is mounted to the hat.

12. The illuminating device of claim 11 wherein the photovoltaic collector is mounted to the crown.

* * * * *